US007293892B2

(12) United States Patent
Issakides

(10) Patent No.: US 7,293,892 B2
(45) Date of Patent: Nov. 13, 2007

(54) INCANDESCENT BODY

(76) Inventor: Georg Issakides, Fleischmarkt 26, AT-1010, Vienna (AT)

( * ) Notice: Subject to any disclaimer, the term of this patent is extended or adjusted under 35 U.S.C. 154(b) by 115 days.

(21) Appl. No.: 10/481,962

(22) PCT Filed: May 15, 2002

(86) PCT No.: PCT/EP02/05341

§ 371 (c)(1),
(2), (4) Date: Aug. 5, 2004

(87) PCT Pub. No.: WO03/001112

PCT Pub. Date: Jan. 3, 2003

(65) Prior Publication Data

US 2005/0024860 A1 Feb. 3, 2005

(30) Foreign Application Priority Data

Jun. 25, 2001 (DE) ..... 101 30 010

(51) Int. Cl.
*F21H 1/00* (2006.01)

(52) U.S. Cl. ..... 362/179; 362/381; 431/100; 431/111

(58) Field of Classification Search ..... 362/179, 362/381, 93, 160, 159, 209, 266, 409, 415; 431/100, 111, 112, 113
See application file for complete search history.

(56) References Cited

U.S. PATENT DOCUMENTS

| | | | | | |
|---|---|---|---|---|---|
| 1,088,654 | A | * | 2/1914 | Flint | 29/428 |
| 1,906,255 | A | * | 5/1933 | Engh | 431/113 |
| 2,715,825 | A | * | 8/1955 | Zimmerman | 431/100 |
| 4,584,426 | A | * | 4/1986 | Nelson | 136/253 |
| 5,104,312 | A | | 4/1992 | Dowst et al. | |
| 5,639,231 | A | | 6/1997 | May et al. | |
| 6,126,888 | A | * | 10/2000 | Goldstein | 264/610 |

FOREIGN PATENT DOCUMENTS

| | | |
|---|---|---|
| DE | 197211 C | 4/1908 |

* cited by examiner

*Primary Examiner*—Ali Alavi
*Assistant Examiner*—Bao Q. Truong
(74) *Attorney, Agent, or Firm*—Donn K. Harms

(57) ABSTRACT

An improved incandescent mantle formed of a woven fabric tube and having at least one open end with a fireproof attaching material provided for attaching at least one of the ends of the tube to a burner. At least one additional fireproof material portion is provided between the burner and mantle to reinforce and protect the mounted mantle from jarring forces.

13 Claims, 7 Drawing Sheets

INCANDESCENT BODY

FIELD OF THE INVENTION

The present invention relates to an incandescent body or mantle comprising a fabric tube having at least one open end, with a fireproof attaching material provided for attaching the ends of the tube to a burner or to a shaped part for a burner of an incandescent lamp.

In addition, the present invention relates to a burner of an incandescent lamp having a rotationally symmetrical surface for attaching at least one end of an incandescent mantle.

BACKGROUND OF THE INVENTION

Such incandescent mantles comprise a circular knitted base material of generally viscose mixed with metallic salts. The mantle is usually attached with a tie string, either directly onto a burner or else first on a prefabricated shaped part for the burner (the shaped part with the attached mantle is placed on the burner by the end user), and is then burned off and brought to luminescence in the gas flame.

When this is done, the base material burns away completely, and all that remains is the oxide skeleton of the metallic salts. Even slight mechanical stresses are sufficient to destroy it. If this oxide skeleton is subjected to jolts or vibrations, as for example during transporting or careless handling of the lamp, the mantle is usually destroyed at its weakest point, namely at the burner.

To increase the mechanical stability of the mantle, the following methods are known in the prior art. One consists in reinforcing the fabric at the point of contact with the burner. To strengthen the oxide skeleton at its point of contact with the burner, the fabric is turned inside out in the vicinity of the burner and chemically reinforced in this area, so that it is doubled. The fabric and the oxide skeleton that remain after combustion now comprise two layers, which are chemically reinforced. This two-layer oxide skeleton increases the time the mantle remains intact on the burner when subjected to jolts and impacts.

Another method consists in the choice of the tie string with which the mantle is tied to the burner. To attach the mantle to the burner, a thread is sewn into the fabric. In the usual attachment method, during production a thread is threaded into the attachment opening or the two attachment openings of the mantle with a greater or lesser number of stitches; the end user then pulls the mantle onto a ceramic ring or an elongated one-piece or two-piece burner and draws the ends of the thread tight and ties them with a knot.

For other types of burners, the mantle is drawn in and pre-knotted already during the production process, the diameter of the opening that thus remains being specified to a precision of tenths of a millimeter.

The attaching material influences the durability of the mantle. The tie string is the most widely used method of attaching the mantle worldwide. However, the selection of the tie string is subject to a variety of criteria. It must be resistant to high temperatures, should retain textile properties even at high temperature and become neither hard nor brittle, and the knot must hold tightly. In addition to use of a tie string, use of a metal clip instead of a tie string has also been proposed.

REFERENCES CITED

U.S. Pat. No. 5,116,220 describes a round metal clip, matched to the shape of the burner but convenient for the consumer to handle, which holds the mantle on the burner and is inserted through the fabric during production, similar to the tie string. The convenience of use of this metal clip is obtained at the cost of the stability of the mantle on the burner, which is less than that of the mantles attached by means of tie string.

The metal clip described above was improved in U.S. Pat. No. 5,639,231, describing a similar metal clip but with a modified form, so that the oxide skeleton is no longer pressed onto the burner by the metal clip. The advantage compared to the metal clip indicated above consists in the improved stability of the mantle on the burner, and the stability achieved is comparable to the stability of a mantle attached using tie string.

THE OBJECTS OF THE INVENTION

The object of the present invention is to provide a mantle, or a burner for mantles, which exhibit increased stability of the mantle when subjected to jolts and impacts, irrespective of the attaching materials indicated above.

SUMMARY OF THE INVENTION

This object is fulfilled with a mantle comprising a fabric tube having at least one open end, a fireproof attaching material being provided for attaching the ends of the tube to a burner or to a shaped part for a burner of an incandescent lamp, by providing at least one additional fireproof material, preferably connected to the mantle, between the burner and the mantle at the at least one open end of the mantle and at least on the side facing the burner or the shaped part for the burner, so that the mantle exhibits increased mechanical stability on the burner as a result.

In addition, the object is fulfilled in a burner of an incandescent lamp having a rotationally symmetrical surface for attaching at least one end of a mantle, by the fact that the surface has a three-dimensional macroscopic structure. To test the mechanical stability of the mantle, the burned-off mantle together with the burner is attached to a jolting machine and shaken until the mantle is damaged. The shaking time is the measure of the mechanical resistance to jolts and impacts. The mantles produced in accordance with the present invention have increased stability and service life, by a factor of more than three.

The mantle was also produced in accordance with the present invention with a round-shaped metal clip (U.S. Pat. No. 5,116,220) instead of the tie string. The produced mantle yielded more than 20 times the stability of the mantle equipped only with the metal clip.

When subjected to jolts, impacts and vibrations, the mantle in accordance with the present invention wears out in an entirely different manner than conventional mantles. The conventional mantle is destroyed by the fact that the oxide skeleton becomes detached successively from the tie string, by jolting and other forces, until it is no longer held by the latter and falls off of the burner. If the mantle produced in accordance with the present invention is subjected to such jolts, impacts and vibrations, the oxide skeleton no longer becomes detached from the tie string, and is held on the burner by the tie string for a significantly longer period. The disclosed mantle herein is destroyed beneath the attachment, namely in the mantle itself, so that the stability of this mantle depends only on the character of the oxide skeleton of which the mantle is made and on the shape of the burner. Thus, when the mantle is subjected to jolts, impacts and vibrations, the additional fireproof material connected to the mantle thereby serves as a protective medium to separate the oxide skeleton from the attaching material that functions as a tying medium, to protect it from these forces. The present invention is based on the separation of these two functions. The protective medium can also assume the function of a spacer. A similar effect is also shown by the macroscopic structure of the burner surface.

Thus, in addition to the tying medium, an additional medium is incorporated into the mantle in the area of the burner. This protective medium may be incorporated for example as a thread, as follows:

a. it is incorporated into the fabric of the mantle with stitches (similar to the way in which the tie string is stitched in.)

b. it is incorporated loop-like around and through the fabric of the mantle in the area of the opening. These may be multiple loops that are incorporated continuously, but may also be individual, separate loops placed at various locations around the opening, each of which may be knotted separately.

c. it may be incorporated by being suspended only on the tying medium on the inner side of the mantle in the area of the burner, by means of a great variety of stitches (such as buttonhole stitching.)

d. it is attached on the inner side of the mantle in the area of the burner (for example by cementing or clipping.)

e. it is incorporated into the fabric of the mantle on the knitting machine, at least in the area of the burner, in the process of knitting the base material (usually viscose) of which the mantle is made.

The thread may be, for example, a thread made up of a minimum proportion of high-temperature material and/or a fabric comprising a minimum proportion of high-temperature material, or a braided thread made up of a minimum proportion of high-temperature material or knitted thread made up of a minimum proportion of high-temperature material.

One advantageous embodiment of the present invention provides that the additional fireproof material is in a crossing arrangement in at least one location when the incandescent mantle is in the attached state. This achieves the advantageous result that the attaching material is kept at a distance at least at some points, namely at the crossing points.

Another advantageous and preferred embodiment of the present invention provides that the additional fireproof material is in the form of a preferably bead-like solid. The beads are strung onto the tie string on the inside of the mantle when the tie string is threaded in, as a means to limit contact with the burner so that at least in partial areas the mantle is no longer in contact with the burner. It is then held exclusively by the tie string. The mechanical explanation of the increased stability is that in static terms the hold is no longer fixed but a rotationally movable hold, so that no bending moments can be introduced into the fabric by the holding point. But shaped parts that are made up of metal, ceramic, porcelain or other high temperature materials are also conceivable as solid bodies. These shaped parts may have any form and design characteristics desired. These shaped parts are attached to the mantle in the area of the burner in such a way that they fulfill a protective function for the mantle as described above.

In an alternative preferred embodiment of the present invention, the fireproof material of the protective body is structured in the form of a flexible body, preferably as a thread. In the production process such a thread may be threaded or knitted into the fabric of the mantle especially advantageously. When the tie string is pulled in to attach the mantle to the burner, the thread forms loops, so that these areas act as a protective medium. A combination of tying medium and protective medium is also conceivable, connected to each other in such a way that the tying medium may be tightened and knotted more or less independently of the protective medium. One example of such a combination is a fabric in which a warp thread is distinguished by being used as a tie string. If such a fabric is stitched into the opening of the mantle like the classic tie string, and if the warp thread which is distinguished as the tie string is drawn tight, the rest of the fabric remains in the opening and bunches up in such a way that it lies between the mantle and the burner. Another example is a tie string which is combined with a protective thread (for example by enmeshing it) and is stitched in the area of the opening of the mantle like the classic tie string in such a way that the tie string may be tightened and knotted so that the protective thread bunches together in the opening and lies between the mantle and the burner.

At the same time, an advantageous refinement of the present invention provides for the thread to be passed loop-like through the fabric tube around its circumference. The at least one loop or the loops do not necessarily need to be present when the mantle is not attached, but may be formed only during attachment of the mantle to the burner. The loops also do not have to be closed, but may also take the form, for example, of meander lines.

The formation of loops may be influenced in an advantageously reproducible way by routing the thread so that it encircles the attaching material, for example the tie string, in at least one place.

A further increase of stability is achievable by routing the thread so that it encircles the end of the fabric tube. That results in the end of the fabric being reinforced at the same time by the loops that are formed. It is also possible to work in the tie string itself around or along the opening of the mantle, after it has been sewn in around the mantle by the usual method, so that it becomes a protective medium in the second pass.

An advantageous refinement of the present invention provides for the tie string to be routed so that it does not penetrate the fabric tube. The result is that the tie string no longer holds the mantle directly, but indirectly via the protective thread. Thus the thread is first sewn, for example, into the mantle, and then the tie string is drawn through the loops of the thread that serves as a protective thread. That makes the holding of the mantle even more flexible. The mantle is held entirely free of the binding forces of the tie string.

To further increase the strength, provision may be made for the end of the fabric tube to be turned inside out. It is preferably turned inward, and the thread may be passed through one or both layers.

For production, to make it easier to recognize the areas that are structured in accordance with the present invention, these may be dyed in the initially continuously knitted tube in such a way that the end of the fabric tube is dyed after it has been separated.

A further advantageous increase in service life is obtained if the end of the fabric tube is chemically reinforced, at least in the area of the protective medium.

For the production process, a design is especially advantageous in which the thread and/or the tie string are incorporated into the fabric tube transversely to the direction of knitting.

The mantles need to be modified only slightly in order to achieve the advantages of the present invention, if the tie string penetrates the fabric tube at a distance from its end, and is attached to the fabric tube in such a way that it forms loops when it is tightened. With this design it is possible to advantageously forego additional spacers or threads. The tie string itself functions as the spacer through the loops that are formed. For example, the tie string itself, after it has been stitched around the mantle in the usual way, is worked in again around or along the opening of the mantle, thus becoming a protective medium in the second pass. Or alternatively, the tie string is not stitched in around the mantle by the usual method. The tie string is stitched in around the opening of the mantle so that in the area of the mantle that faces the burner, the string lies in between. It thus becomes simultaneously tying medium and protective medium.

An advantageous design of the burner provides for the surface to have a three-dimensional macroscopic structure, with the structure preferably being in the form of waves whose crests are oriented parallel to one axis of the rotationally symmetrical surface. This design is especially advantageous in terms of the production technique.

Alternatively, the structure may be in the form of nubs.

BRIEF DESCRIPTION OF THE DRAWINGS

An example of the present invention is described on the basis of a drawing. The figures of the drawing show the following details.

DETAILED DESCRIPTION OF THE PREFERRED EMBODIMENTS

Figure 1:
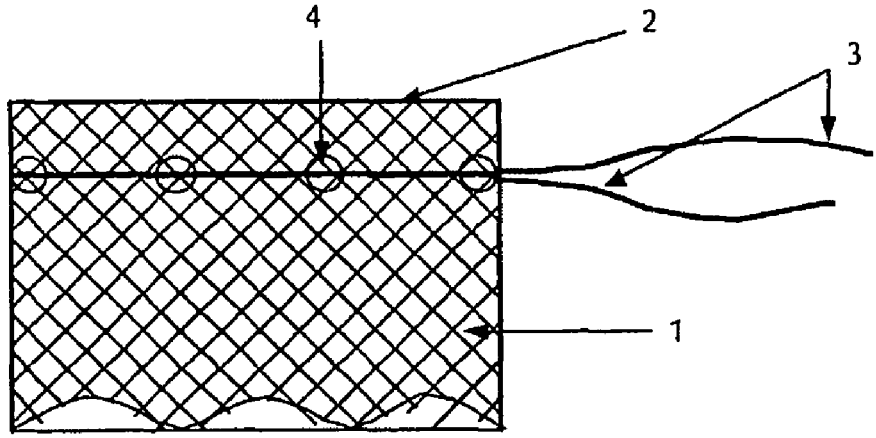
FIG. 1 is a schematic side view of a mantle according to the present invention in the unattached state, according to a first exemplary embodiment.
Figure 2:
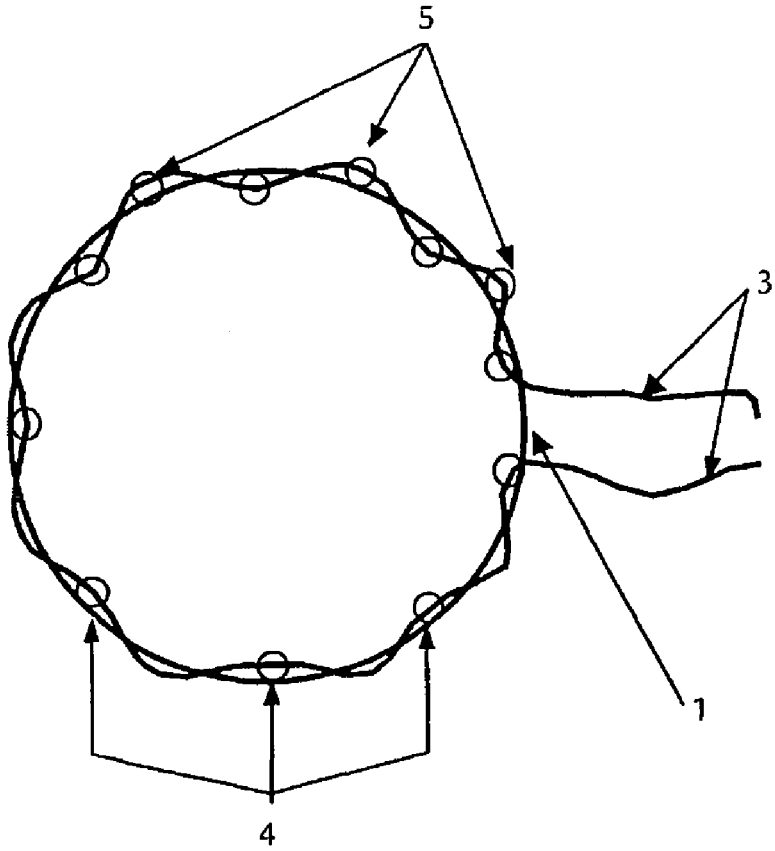
FIG. 2 is a top view of the end of a mantle according to the present invention, in accordance with FIG. 1.

In FIGS. 1 and 2, reference 1 designates the mantle, which is initially knitted continuously and has an open end 2 after a severing cut. At a preselected distance from end 2, a tie string 3 is drawn through the circumference of the mantle in such a way that it is alternately on the inside and the outside. Bead-like fireproof bodies 4 are strung on the sections of tie string 3 that are on the inside. For this purpose, these bodies have appropriate bores through which the tie string may be passed. This arrangement is preferred.

Figure 3:
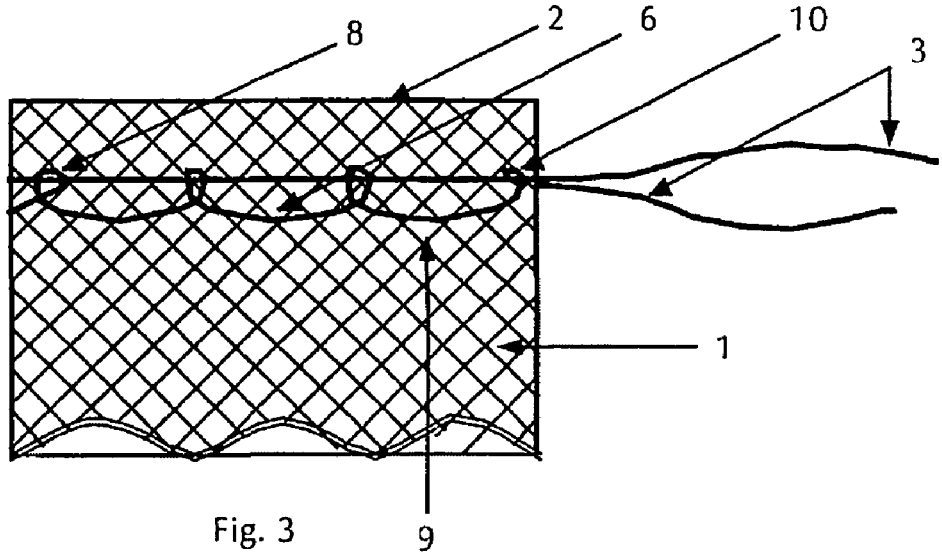
FIG. 3 is a schematic side view of a mantle according to the present invention in the unattached state, according to a second exemplary embodiment.
Figure 4:
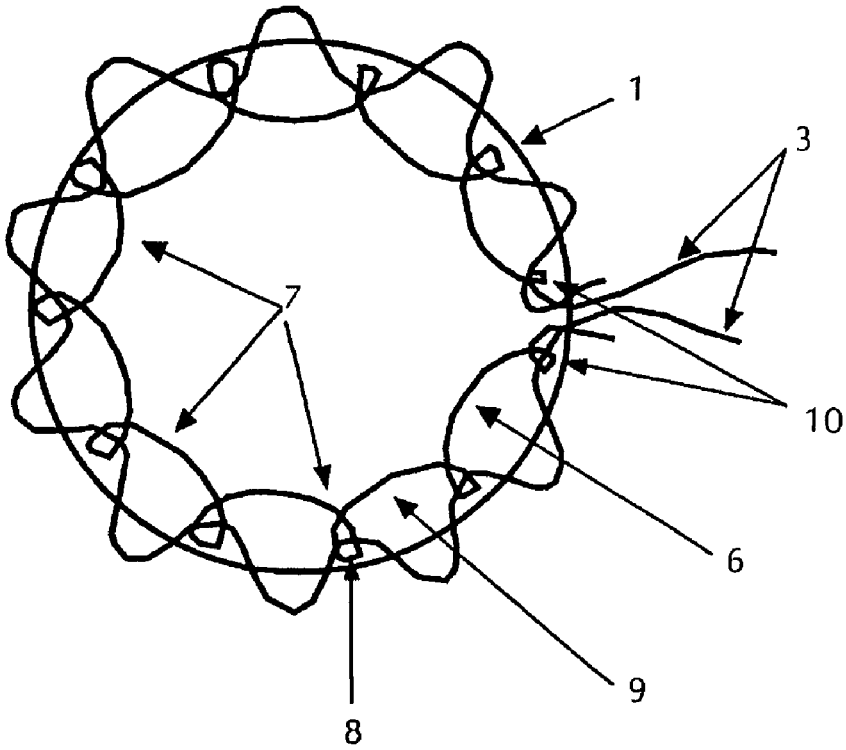
FIG. 4 is a top view of the end of a mantle according to the present invention, in accordance with FIG. 3.

FIGS. 3 and 4 show an alternative exemplary embodiment, in which a thread 6 acts as a protective medium. As in the previously described example, the tie string is passed alternately through the mantle. In the areas 7 of string 3 that lie toward the inside, thread 6 is passed around the latter in the form of a loop 8 and attached to tie string 3 so that it can slide. The ends of thread 6 are affixed to the mantle by means of a knot 10. When tie string 3 is drawn tight, thread 6 forms loops 9. The formation of the loops 9 can be influenced reproducibly by the routing and/or nature of the loops 8.

Figure 5:
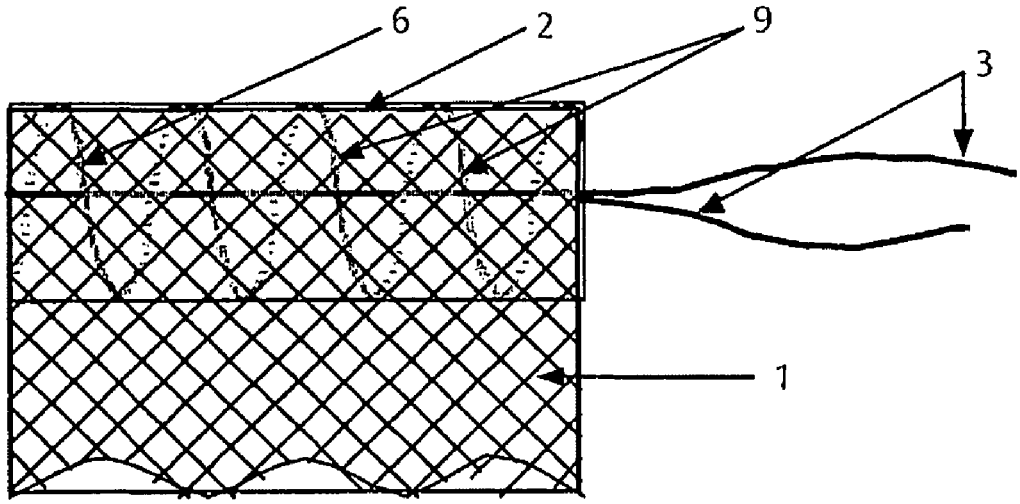
FIG. 5 is a schematic side view of a mantle according to the present invention in the unattached state, according to a third exemplary embodiment.
Figure 6:
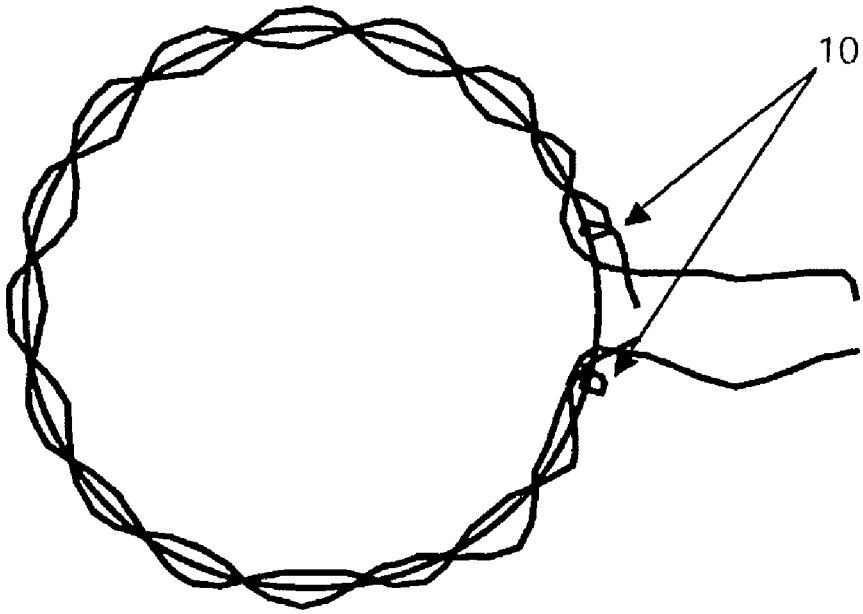
FIG. 6 is a top view of the end of a mantle according to the present invention, in accordance with FIG. 5.

FIGS. 5 and 6 show an additional exemplary embodiment, in which thread 6, which serves as a protective medium, is passed alternately through mantle 1 at its upper end 2. When tie string 3 is drawn tight loops 9 are formed, which encircle the end of mantle 1 in the manner of a buttonhole stitch. This type exhibits especially great durability.

Figure 7:
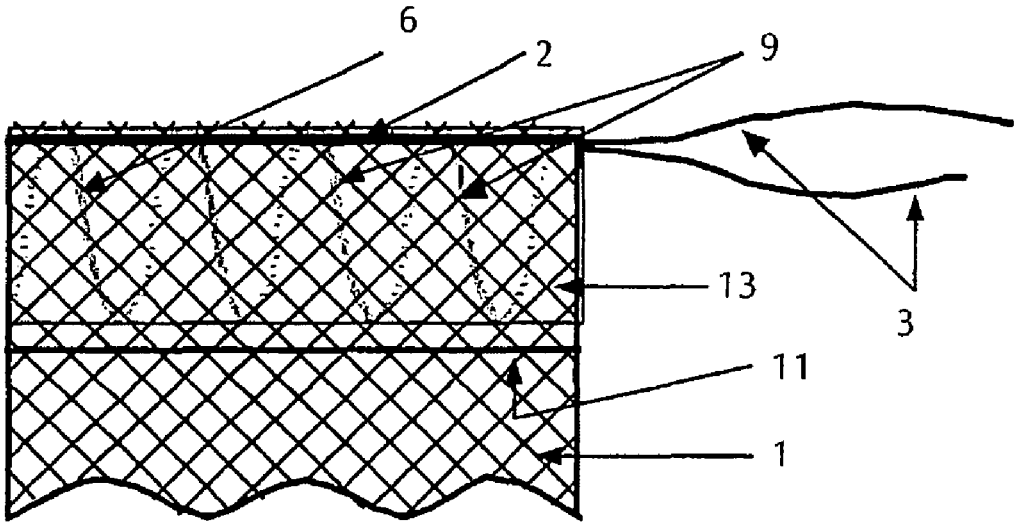
FIG. 7 is a schematic side view of a mantle according to the present invention in the unattached state, according to a fourth exemplary embodiment.
Figure 8:
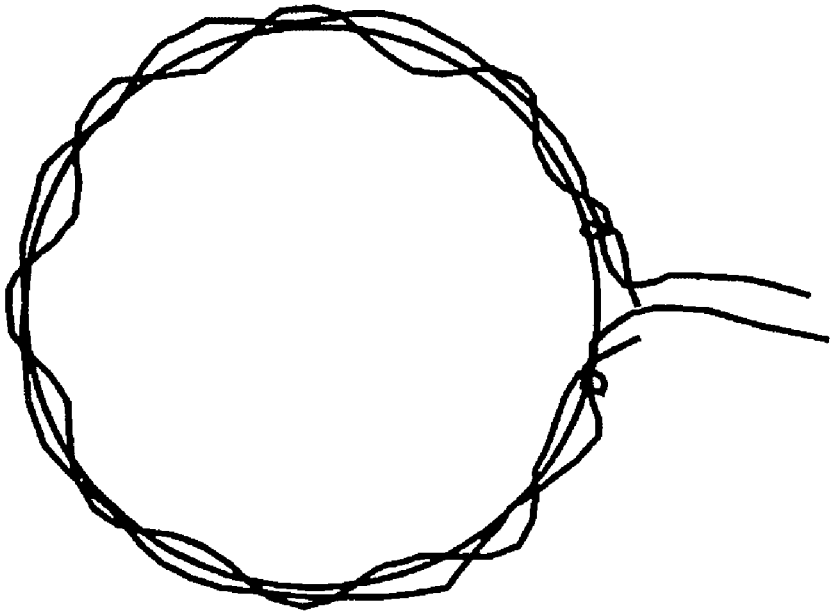
FIG. 8 is a top view of the end of a mantle according to the present invention, in accordance with FIG. 7.

FIGS. 7 and 8 represent a variant of the design according to FIGS. 5 and 6. In contrast to FIGS. 5 and 6, the tie string is not passed through mantle 1, but through the upper ends of loops 9 of thread 6, so that mantle 1 is now attached to a burner indirectly through thread 6. In addition, means to reinforce the end 2 the mantle is provided by it being turned inside out, so that it is double-layered in the area between end 2 and cut edge 11. In addition, this area can also be chemically reinforced and/or dyed. The area that is turned inside out may also be knitted of fireproof material, and may thus represent a fabric 13 according to the present invention which assumes the protective function.

Figure 9:
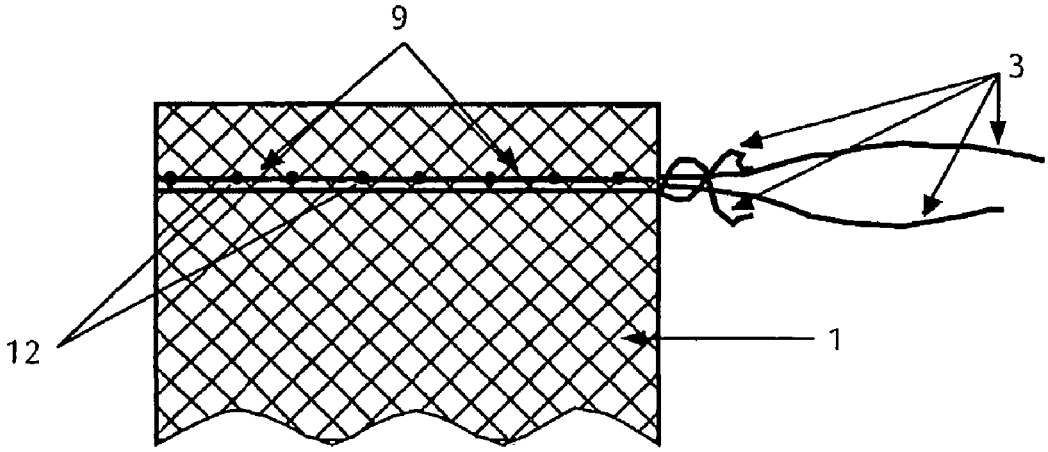
FIG. 9 is a schematic side view of a mantle according to the present invention in the unattached state, according to a fifth exemplary embodiment.

FIG. 9 represents an exemplary embodiment in which the tie string assumes both the protective function and the tying and holding function. To that end, tie string 3 is run twice around the circumference of the mantle and is passed through it alternately a number of times. In the course of one pass around it is firmly connected to the mantle at several places 12, while in the course of the second pass around it penetrates the mantle movably. When the tie string is drawn tight, it therefore forms loops in the area with the attachment points 12.

The mantle that is processed by means of a protective medium in the area of the burner according to the methods indicated above has significantly greater stability when it is subjected to impacts, jolts and vibrations. Without major sacrifices of stability, as an alternative to the traditional processing method, i.e. wrapping the mantle so that the fabric of the mantle is in two layers where it contacts the burner and sewing the tie string through both layers of fabric, the mantle produced in accordance with the present invention may be processed as follows:

a. The fabric of the mantle is turned inside out in the known manner, but the tying medium is sewn through only one chosen layer of the mantle fabric (depending on the nature of the burner). This enables the sewing of the tying medium to be performed more simply and more quickly.

b. The fabric of the mantle is not turned inside out, and the tying medium is sewn through only one layer of mantle fabric. The sewing of the tying medium can be performed more simply and more quickly.

c. The tying medium can be introduced more simply, more quickly and with perfect regularity, by incorporating the tying medium on the knitting machine in the process of knitting the base material (usually viscose) of which the mantle is made, and transversely to the direction of knitting, at the place that is attached to the burner. This tying medium, which is included in the knitting, is also subjected to the further processing of the knit goods, without exception, until the mantle is completed. The tying medium which is thus included in the knitting can be handled in the same way as the tie string that is sewn in the traditional manner with more or fewer stitches, in order to attach the mantles to the burner.

Figure 10:
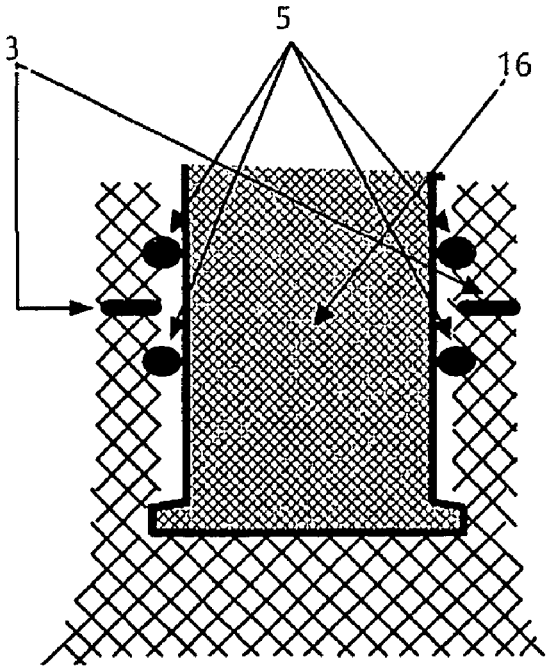
FIG. 10 is a schematic vertical section through a burner with the end of a mantle attached to it.
Figure 11:
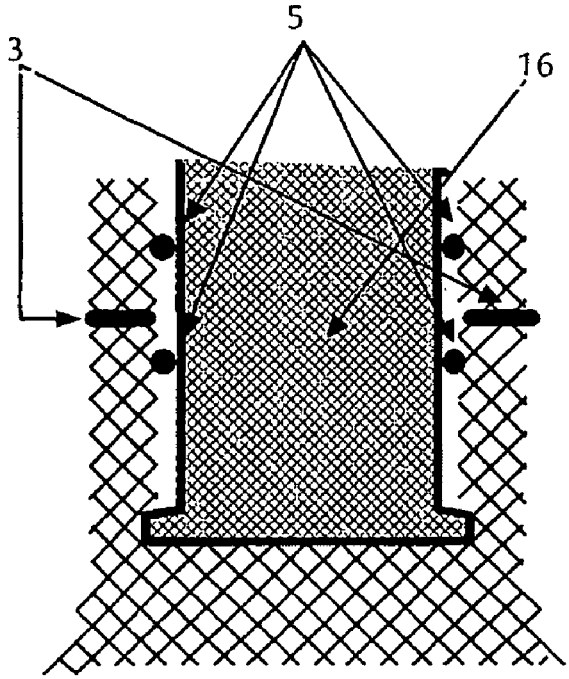
FIG. 11 is a schematic vertical section through a burner with the end of a mantle attached to it in a different manner.

In FIG. 10, the two threads provided in the form of fireproof material 5 are sewn only into the inner fabric of the mantle facing the burner, and tie string 3 is sewn through both layers of fabric. After the mantle is attached to the burner, the fireproof material is drawn up but is not tied, so that it lies slack in the fabric. In FIG. 11, the threads in the form of a fireproof material 5 are attached to the burner with a cement that burns up completely in the heat, and the mantle is attached to the burner only with the tie string. The fireproof material has thus been connected neither to the mantle nor to the burner. Surprisingly, both embodiments showed outstanding stability in tests.

Figure 12:
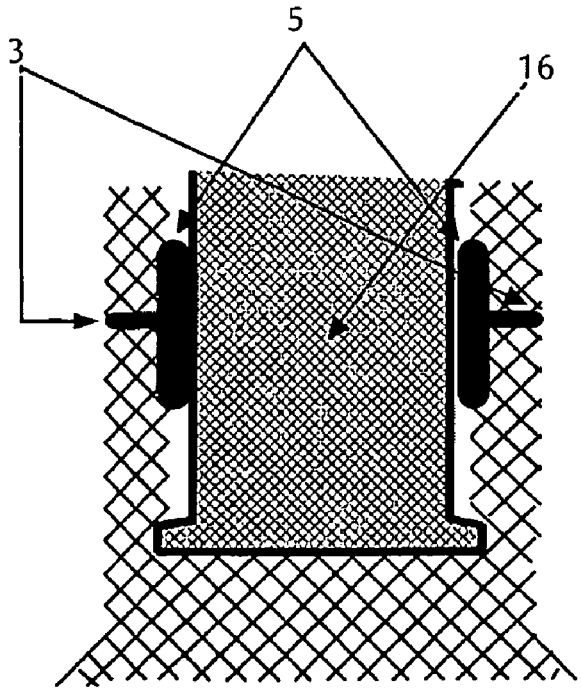
FIG. 12 is a schematic vertical section through a burner with the end of a mantle attached to a fabric on it.
Figure 13:
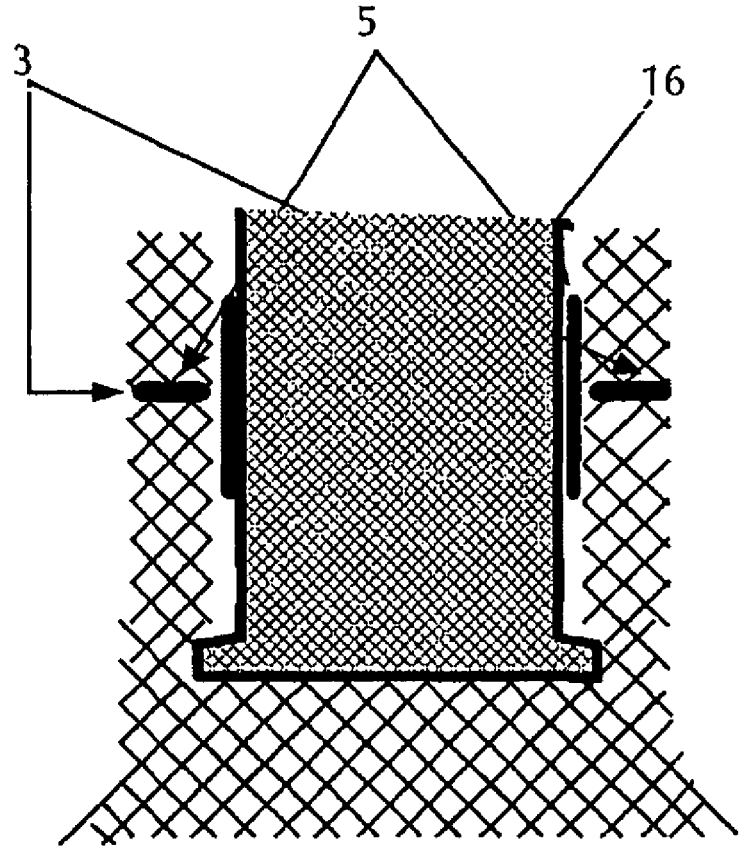
FIG. 13 is a schematic vertical section through a burner with the end of a mantle attached to a fabric on it in a different manner.

FIG. 12 shows a mantle with a fireproof fabric 13 on the inside, which is attached to the mantle with tie string 3, and FIG. 13 shows the case of a fabric applied to the burner and a mantle tied to it. These embodiments also do not differ in their outstanding stability in tests.

Figure 14:
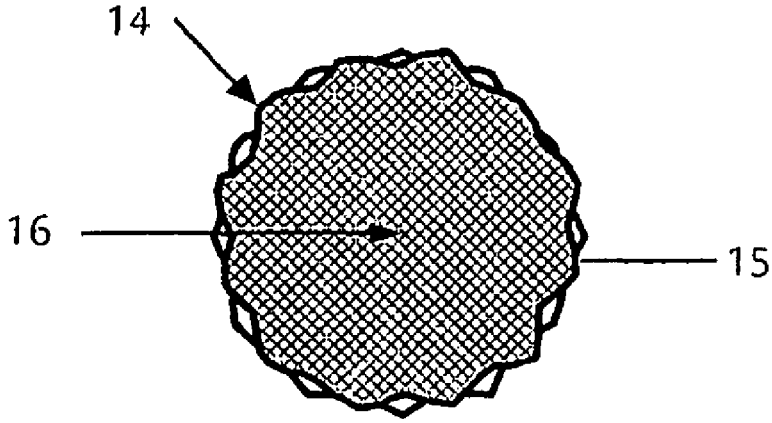
FIG. 14 is a schematic horizontal section through a surface of a burner intended for attaching a mantle.

Finally, FIG. 14 shows a schematically represented horizontal section through a surface 14 of a burner 16, which is intended for attachment of a mantle. The surface has a macroscopic structure 15 in the form of nubs and/or waves.

What is claimed is:

1. In an incandescent mantle formed of a woven fabric tube and having at least one open end with a fireproof attaching material provided for attaching at least one of the ends of the tube to a burner or to a shaped part for a burner of an incandescent lamp, the improvement comprising:

engaged upon at least one open end of the mantle, on at least a side facing the burner or the shaped part for the burner, at least one additional fireproof material portion in the form of a flexible thread is provided between the burner and mantle when said mantle is in an attached state engaged with said burner;

said thread in the attached state is passed around the circumference of the fabric tube in at least one location forming a loop;

said attaching material is routed not to penetrate the fabric tube; and said thread being routed to wind around the attaching material in at least one place, preferably winding around the inside, thereby imparting to the mantle increased mechanical stability with respect to the burner as a result.

2. The incandescent mantle according to claim 1, wherein the additional fireproof material portion is in a crossing arrangement in at least one location when said mantle is in the attached state.

3. In an incandescent mantle formed of a woven fabric tube and having at least one open end with a fireproof attaching material provided for attaching at least one of the ends of the tube to a burner or to a shaped part for a burner of an incandescent lamp, the improvement comprising: engaged upon at least one open end of the mantle, on at least a side facing the burner or the shaped part for the burner, at least one additional fireproof material portion in the form of a substantially bead-like solid is provided between the burner and mantle when said mantle is in an attached state engaged with said burner thereby imparting to the mantle increased mechanical stability with respect to the burner as a result.

4. The incandescent mantle according to claim 3, wherein the additional fireproof material portion additionally comprises a flexible body, substantially as at least one thread.

5. The incandescent mantle according to claim 4 wherein the at least one thread in the attached state is passed around the circumference of the fabric tube in at least one location, forming a loop.

6. The incandescent mantle according to claim 5 wherein the thread is routed to wind around the attaching material in at least one place, preferably winding around the inside.

7. The incandescent mantle according to claim 4 wherein the thread is routed to wind around the end of the fabric tube.

8. The incandescent mantle according to claim 3 wherein the attaching material is routed not to penetrate the fabric tube.

9. The incandescent mantle according to claim 1, wherein the end of the fabric tube is turned inside out.

10. The incandescent mantle according to claim 2, wherein the end of the fabric tube is turned inside out.

11. The incandescent mantle according to claim 1, wherein the end of the fabric tube is dyed.

12. The incandescent mantle according claim 1 wherein the end of the fabric tube is chemically reinforced at least in the area of the fireproof attaching material.

13. The incandescent mantle according to claim 1 wherein the fireproof attaching material, is in the form of a thread, is introduced into the fabric tube during the knitting, transversely to the direction of knitting.

* * * * *